United States Patent [19]

Handler

[11] Patent Number: 4,887,338

[45] Date of Patent: Dec. 19, 1989

[54] SHEAR TRAP HOOK AND LOOP FASTENING SYSTEM

[75] Inventor: Michael D. Handler, Norwalk, Conn.

[73] Assignee: Velcro Industries B.V., Amsterdam, Netherlands

[21] Appl. No.: 161,330

[22] Filed: Feb. 19, 1988

Related U.S. Application Data

[63] Continuation of Ser. No. 893,390, Aug. 5, 1986, abandoned.

[51] Int. Cl.[4] ..... A44B 18/00

[52] U.S. Cl. ..... 24/306; 24/442; 248/205.2

[58] Field of Search ..... 248/205, 2; 24/442, 24/306, 64, 580, 588, 581, 589, 697, 304, 487, 557, 558, 565, DIG. 11, 664; 2/DIG. 11, DIG 6; 52/DIG. 13; 160/327, 328; 297/DIG. 4

[56] References Cited

U.S. PATENT DOCUMENTS

| | | | |
|---|---|---|---|
| 680,047 | 8/1901 | King | 24/64 |
| 739,471 | 9/1903 | Allison . | |
| 1,638,073 | 8/1927 | Van Heusen . | |
| 1,770,836 | 7/1930 | Boote . | |
| 2,655,622 | 10/1953 | Besay et al. | 24/664 X |
| 2,728,480 | 12/1955 | Close . | |
| 3,063,749 | 11/1962 | Struble . | |
| 3,067,903 | 12/1962 | Jones, Jr. . | |
| 3,101,517 | 8/1963 | Fox et al. . | |
| 3,164,259 | 1/1965 | De'Caccia . | |
| 3,176,364 | 4/1965 | Dritz . | |
| 3,192,306 | 6/1965 | Skonnord . | |
| 3,251,399 | 5/1966 | Grossman . | |
| 3,338,291 | 8/1967 | Kinter | 24/306 X |
| 3,370,818 | 2/1968 | Perr . | |
| 3,413,656 | 12/1968 | Vogliano et al. . | |
| 3,455,589 | 7/1969 | Valiulis | 24/442 X |
| 3,460,860 | 8/1969 | Stevens, Jr. . | |
| 3,475,810 | 11/1969 | Mates . | |
| 3,491,486 | 1/1970 | Caruth . | |
| 3,491,909 | 1/1970 | Ikelheimer . | |
| 3,499,695 | 3/1970 | Studinski . | |
| 3,506,321 | 4/1970 | Hampel . | |
| 3,512,318 | 5/1970 | Turner . | |
| 3,566,556 | 3/1971 | Nichols . | |
| 3,668,808 | 6/1972 | Perina . | |
| 3,680,177 | 8/1972 | Ginsberg . | |
| 3,696,472 | 10/1972 | Perina et al. . | |
| 3,721,050 | 3/1973 | Perina . | |
| 3,742,644 | 7/1973 | Williams . | |
| 3,745,709 | 7/1973 | Perina . | |
| 3,747,754 | 7/1973 | Nix et al. . | |

(List continued on next page.)

FOREIGN PATENT DOCUMENTS

| | | | |
|---|---|---|---|
| 0682583 | 3/1964 | Canada . | |
| 2002720 | 2/1979 | Fed. Rep. of Germany . | |
| 2565812 | 12/1985 | France . | |
| 0562962 | 5/1957 | Italy . | |
| 248783 | 2/1948 | Switzerland | 24/557 |
| 0387473 | 5/1965 | Switzerland . | |
| 0042477 | 5/1968 | Switzerland . | |

*Primary Examiner*—James R. Brittain

*Attorney, Agent, or Firm*—Norman P. Soloway

[57] ABSTRACT

An improvement to hook and loop fastening systems of the type comprising one portion composed of backing material having a hooked surface thereon and another portion composed of backing material having a looped surface thereon. The improvement allows for releasably fastening two components together with the hook and loop materials in shear and is characterized by a planar member having one of the components attached to the end thereof and having outer faces each having one of the portions of the fastening system thereon; and, a U-shaped shear trap channel member having the other of the components attached to the closed end of the U and having inner faces on the sides of the U each having the other of the portions of the fastening system thereon. The shear trap member is adapted to receive the planar member between the inner faces with the portions of the loop fastening portions in engagement; and, is further adapted to have the sides pivoted adjacent the closed end of the U to allow progressive disengagement of the portions of the fastening system.

29 Claims, 7 Drawing Sheets

U.S. PATENT DOCUMENTS

| | | | |
|---|---|---|---|
| 3,777,435 | 12/1973 | Penna | 52/DIG. 13 |
| 3,780,479 | 12/1973 | Billarant et al. . | |
| 3,854,239 | 12/1974 | Williams . | |
| 3,856,369 | 12/1974 | Commiant . | |
| 3,892,451 | 7/1975 | Bruins . | |
| 3,905,062 | 9/1975 | de Navas Albareda | 2/DIG. 6 |
| 3,908,830 | 9/1975 | Skrzelowski . | |
| 3,940,873 | 3/1976 | Lawless . | |
| 3,954,202 | 5/1976 | Petrick . | |
| 4,028,855 | 6/1977 | Prewer . | |
| 4,047,337 | 9/1977 | Bergstrom . | |
| 4,084,865 | 4/1978 | Joyce . | |
| 4,163,303 | 8/1979 | Hanna . | |
| 4,165,555 | 8/1979 | Boxer et al. . | |
| 4,170,082 | 10/1979 | Freedman . | |
| 4,260,077 | 4/1981 | Schroeder . | |
| 4,271,566 | 1/1981 | Perina . | |
| 4,273,130 | 6/1981 | Simpson | 24/306 X |
| 4,275,520 | 6/1981 | Appleton et al. . | |
| 4,308,642 | 1/1982 | Heyman | 24/306 |
| 4,352,524 | 10/1982 | Crosby | 24/442 X |
| 4,361,099 | 11/1982 | Kokenge et al. . | |
| 4,416,038 | 11/1983 | Morrone III | 24/487 |
| 4,452,362 | 6/1984 | Mancin . | |
| 4,489,115 | 12/1984 | Layman et al. . | |
| 4,493,174 | 1/1985 | Arens . | |
| 4,509,930 | 4/1985 | Schweigert et al. . | |
| 4,518,191 | 5/1985 | Williams et al. . | |
| 4,524,992 | 6/1985 | Linn | 24/487 X |
| 4,534,473 | 8/1985 | Post . | |
| 4,548,375 | 10/1985 | Moss | 248/205.2 |
| 4,635,418 | 1/1987 | Hobgood . | |

PRIOR ART

SHEAR TRAP HOOK AND LOOP FASTENING SYSTEM

This is a continuation of co-pending application Ser. No. 893,390 filed on Aug. 5, 1986.

BACKGROUND OF THE INVENTION

The present invention relates to releasable fastening systems and, more particularly, to an improvement to hook and loop fastening systems of the type comprising one portion composed of backing material having a hooked surface thereon and another portion composed of backing material having a looped surface thereon. The improvement allows for releasably fastening two components together with the hook and loop materials in shear and is characterized by a planar member having one of the components attached to the end thereof and having outer faces each having one of the portions of the fastening system thereon; and, a U-shaped member having the other of the components attached to the closed end of the U and having inner faces on the sides of the U each having the other of the portions of the fastening system thereon, wherein the U-shaped member is adapted to receive the planar member between the inner faces with the portions of the loop fastening portions in engagement and is further adapted to have at least one side pivoted adjacent the closed end of the U to allow progressive disengagement of the portions of the fastening system.

Hook and loop fastening material as sold by the assignee of the present application under trademark VELCRO is well-known and well-accepted commercially. The basic concept thereof is shown in FIGS. 1 and 2. The fastening system, generally indicated as 10, includes a first portion comprising a first strip of flexible backing material 12 having a loop material 14 on one side thereof. The second portion comprises a second flexible backing material 16 having resilient hooks 18 extending from one side thereof. For purposes of simplicity in the drawings, the hooks 18 are shown enlarged and few in number. In actuality, in the commercial product, the hooks 18 are quite small and are many in number. The hooks can either be T-shaped, as shown, or alternatively, J-shaped, or the like.

Typically, the two portions are attached to two members to be releasably joined as by sewing, ultrasonic welding or adhesive. When the two portions are pushed together in the manner of FIG. 2, the hooks 18 catch in the loop material 14 and resist separation. To separate the portions, they are "peeled" apart as indicated by the arrow 20 in FIG. 3 such that the hooks 18 and the loop material 14 are progressively separated rather than attempting to separate them all simultaneously. In order to separate the portions, the hooks 18 must be deformed in the area of the projections 22 to release the engagement of the hooks 18 with the loop material 14.

Turning now to FIG. 4, the basic problem to be solved by the present invention is depicted. If there were a rigid U-shaped channel 24 as shown having a bar or plate 26 disposed therein; and, if hook and loop fastening systems 10 were disposed between the bar or plate 26 and the sides of the U-shaped channel 24 and attached thereto as with adhesive, the bar or plate 26 would be maintained within the U-shaped channel 24 by the hook and loop fastening systems 10 being what is referred to as "in shear". That is, in order for the bar or plate 26 to be pulled from the U-shaped channel 24, both the stems 28 and the projections 22 of the hooks 18 would have to be deformed in order to break their grip on the loop material 14. Moreover, as opposed to the progressive disengagement normally employed as depicted in FIG. 3, total disengagement would have to be undertaken simultaneously. As a result, hook and loop fastening material operating "in shear" in the manner of FIG. 4 is quite strong. For example, in one test it was found that a representative sample took two pounds of force to separate the portions in the progressive manner of FIG. 3 whereas twenty pounds of force were required to release the materials in the shear direction. Greater insight can be gained with respect to using such hook and loop fastening materials in shear and, in particular, with the problem of separating rigid members joined by hook and loop fastening material by reference to U.S. Pat Nos. 4,271,566 of Perina and 3,475,810 of Mates, both of which are assigned to the assignee of the present application.

From the foregoing, it will be appreciated that hook and loop fastening material operated in shear could be employed to support large loads. Unfortunatly, without a means for releasing the material other than the shear direction or the use of a separate releasing device as described in the above-referenced Mates patent, such use is often impractical.

Wherefore it is the object of the present invention to provide a means for using hook and loop fastening systems in shear while allowing progressive disengagement of the components even when rigid materials are employed.

SUMMARY

The foregoig object has been accomplished by the shear trap channel hook and loop fastening system of the present invention comprising, a planar member adapted to have one component attached thereto and having outer faces each having one of the hook and loop materials thereon; and, a trap channel member adapted to have another component attached thereto and having parallel inner faces each having the other of the hook and loop materials thereon. The trap channel member is adapted to receive the planar member between the inner faces with the respective hook and loop materials in engagement. The trap channel member is also adapted to have the inner faces hinge outward from one another in a manner to effect progressive disengagement of the surface portions from one another.

In the preferred embodiment as shown for heavy duty applications, the shear trap member is a resiliently rigid channel having a back portion and two parallel facing side portions wherein one of the side portions is hingedly attached to the back portion. In one of the embodiments, which provides for maximum ease of separation, the shear trap member has both side portions hingedly attached to the back portion.

Further in the preferred embodiment, the shear trap member is formed of plastic and the hinged attachment comprises a living hinge. For ease of gripping and effecting release, it is also preferred that the hinged side members include a gripping portion opposite the back side of the channel whereby the side member can be gripped to pull the surface portions out of engagement.

To increase the holding power and when used in a decorative environment the preferred embodiment includes a locking strip adapted to snap over a portion of the channel in releasable engagement with the side portions to prevent the side portions from separating and allowing the surface portions to become disengaged. Moreover, the locking strip is adapted to cover all of the shear trap members not having the planar member disposed therebetween.

DESCRIPTION OF THE DRAWINGS

FIG. 10 is a simplified cross-section showing how the attachment system of the present invention in the first embodiment can be used in a horizontal configuration for mounting a shelf, or the like.

DESCRIPTION OF THE PREFERRED EMBODIMENT

Figure 5:
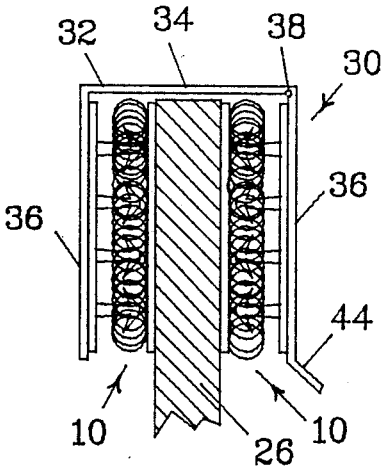
FIG. 5 is a simplified drawing corresponding to the drawing of FIG. 4 showing the present invention in a first embodiment accomplishing the same results but in a manner which allows release without pulling the hook and loop fastening system through the shear engagement.
Figure 6:
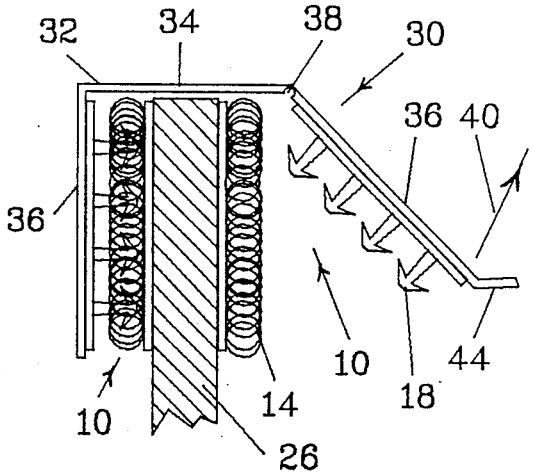
FIG. 6 shows the fastening system of FIG. 5 with one side of the channel pulled away to disengage the hook and loop fastening materials on one side.
Figure 7:
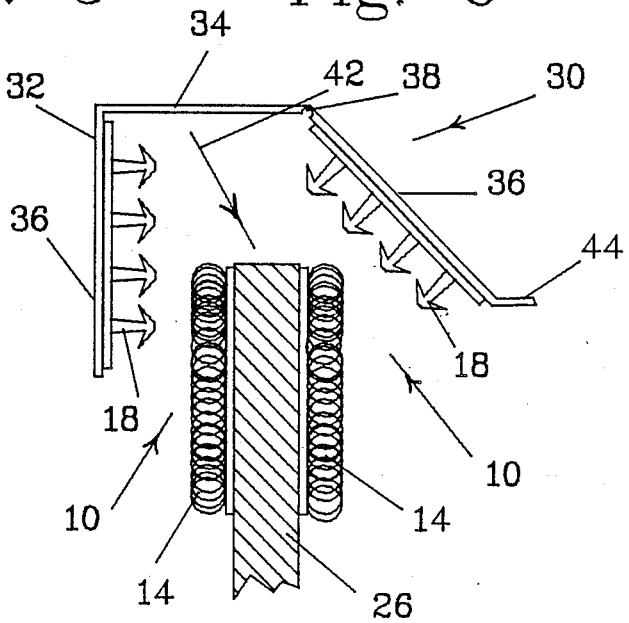
FIG. 7 shows the apparatus of FIG. 6 and how the plate can be pulled from the channel to disengage the other hook and loop fastening portion.

Turning now to FIGS. 5–7, the present invention is shown in a first form. The system of the present invention is generally indicated as 30 and is referred to as a "shear trap" system because the heart of the system is the channel 32 which is a releasable trap channel. As described herein, the channel 32 is formed of a rigid plastic material of a type well known in the art which is capable of having a so-called "living hinge" resiliently formed therein. As will be appreciated by those skilled in the art, for heavy-duty applications, the channel 32 could be formed of, for example, aluminum with pin-type hinges, or the like, used where hinges are described hereinafter.

Channel 32 has a back portion 34 from which two parallel side portions 36 extend at right angles. In this particular embodiment, one side portion 36 joins the back portion 34 at an area of reduced thickness forming a living hinge at 38. As with the construction previously described with respect to FIG. 4, half of conventional hook and loop fastening material 10 is fastened to the bar or plate 26 while the other half is fastened to the side portions 36 of the channel 32.

Figure 1:
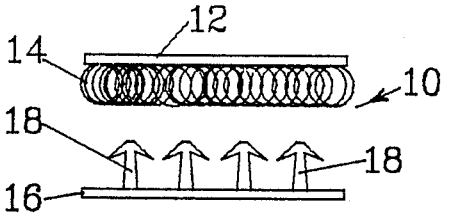
Fig. 1 PRIOR ART
FIG. 1 is a simplified side view of basic hook and loop fastening materials as known in the art.
Figure 2:
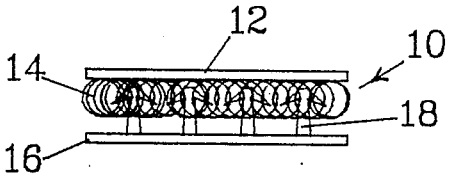
Fig. 2 PRIOR ART
FIG. 2 shows the material of FIG. 1 in their pressed-together or fastened configuration.
Figure 3:
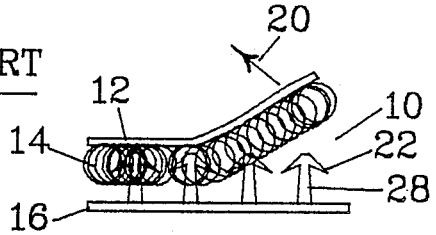
FIG. 3 is a drawing showing the fastened materials of FIG. 2 in the prior art manner of separation thereof.
Figure 4:
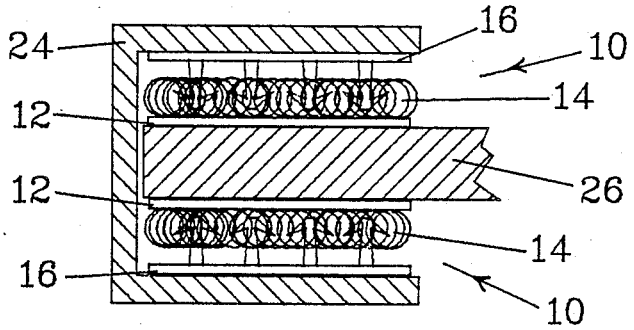
FIG. 4 is a simplified cutaway view through a U-shaped channel having a rigid strip disposed therein and maintained thereon both sided by hook and loop fastening material operating "in shear".

In its closed position as shown in FIG. 5, the system 30 of the present invention operates in shear in the same manner as the channel 24 of FIG. 4. To release the system 30, however, the side portion 36 connected by the living hinge 38 is pulled progressively out of engagement as indicated by the arrow 40 in FIG. 6. The bar or plate 26 can then be disengaged from the other hook and loop fastening system 10 attached to the other side portion 36 and can be pulled away as indicated by the arrow 42 of FIG. 7. In order to provide a grip for the pivoting disengagement of the one side portion 36, it is convenient to provide a gripping lip 44 along the outer edge thereof.

It should be noted in passing at this point that, in the drawings herein, the hook-containing portion of the fastening system 10 is shown mounted to the side portions 36 while the loop-containing portion is attached to the removable bar or plate 26. This could, of course, be reversed or, if desired, they could be mounted in alternate configurations such that the plate or bar 26 would only be fastenably receivable within the channel 32 in one direction.

Figure 8:
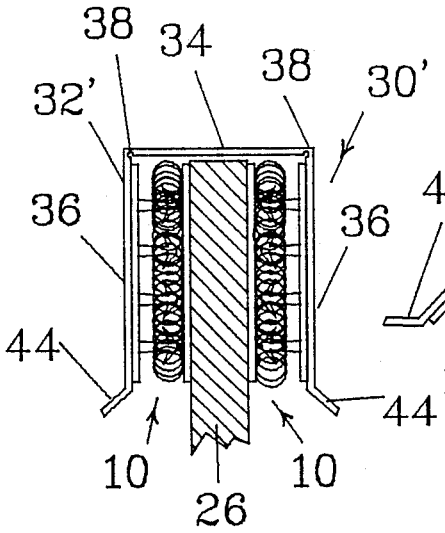
FIG. 8 shows the present invention in simplified cross-section according to a second embodiment where both sides of the channel are capable of hinged disengagement.
Figure 9:
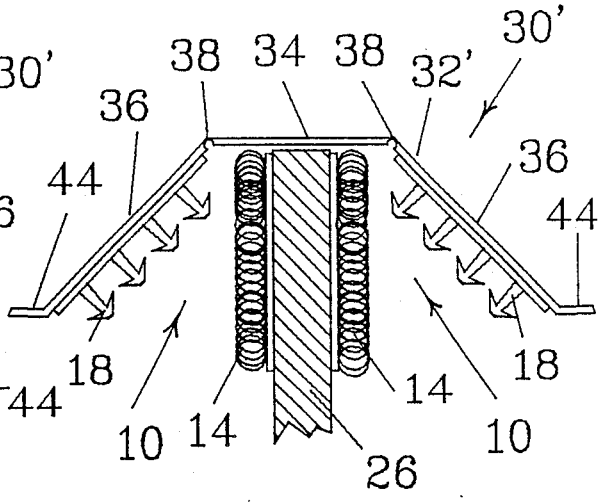
FIG. 9 shows the fastening system of FIG. 8 with both sides of the channel disengaged to allow the strip to be easily removed.

Turning now to FIGS. 8 and 9, the fastening system 30' is shown in an alternate embodiment wherein both side portions 36 are connected to the back portion 34 by living hinges 38. Since both side portions 36 are pivotable to the position of FIG. 9, gripping lips 44 are also provided on both side portions 36. By having both side portion 36 pivotable, the channel 32' is more easily releasable from engagement with the fastening materials on the bar or plate 26. Several more specific examples of the use of the present invention will now be described.

Figure 10:
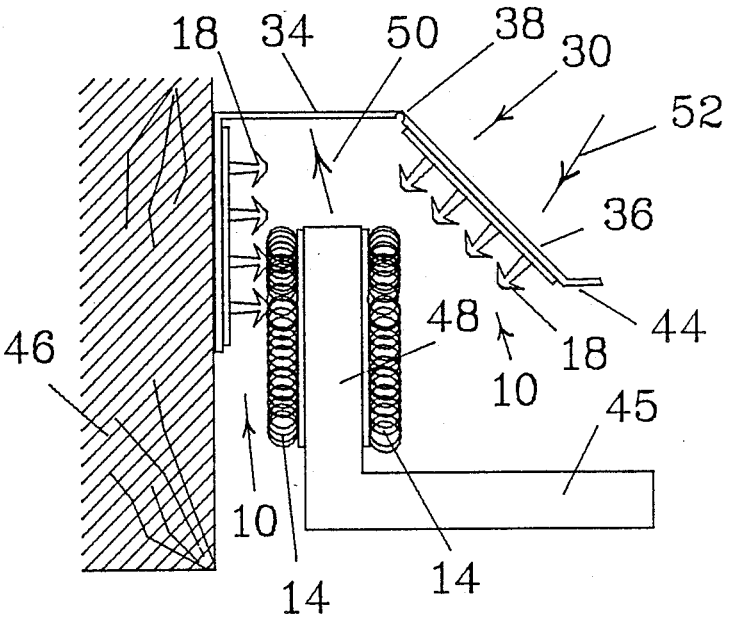

FIG. 10 shows a side view of a shelf 45 being releasably attached to a wall panel 46 by the system 30 of the present invention according to the embodiment of FIGS. 5–7 mounted in a horizontal position. It will be appreciated that having only the outer side portion 36 of the channel 32 pivotable is preferred in this configuration. The non-hinged side portion 36 is attached to the wall panel 46 with adhesive, screws, or the like. To attach the shelf 44 to the wall, the vertical portion 48 having the loop material 14 thereon is inserted into the channel 32 in the direction of arrow 50 and then the outer (i.e. hinged) side portion 36 is pressed into engagement as indicated by the arrow 52 so as to place the fastening system 30 in its closed position as previously shown in FIG. 5. The shelf 45 can, of course, be removed by simply releasing the outer side member 36 and then pulling the vertical portion 48 from engagement with the inner side member 36.

Figure 11:
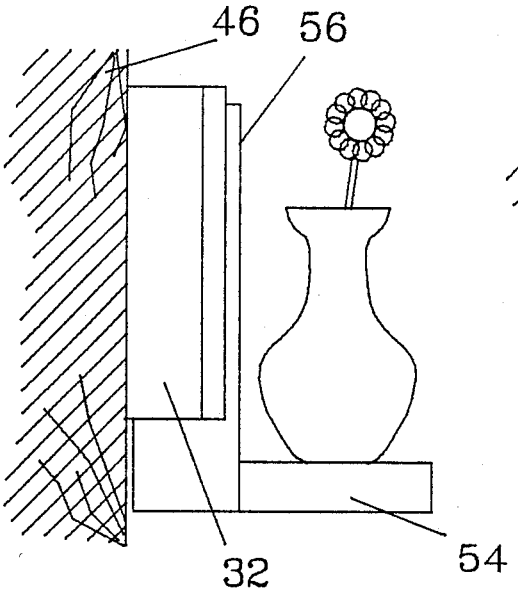
FIG. 11 is a simplified side elevation showing a vertical mounting of a shelf support according to the present invention wherein the shear trap channel is attached to a wall.
Figure 12:
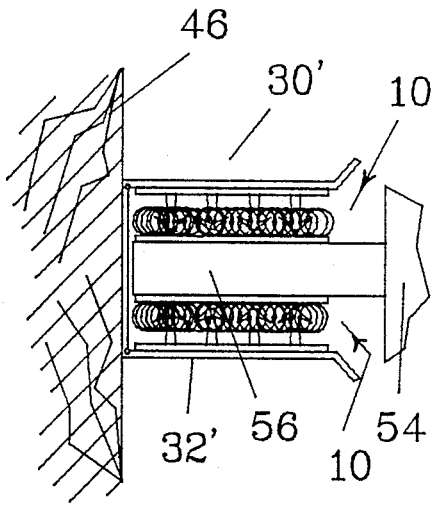
FIG. 12 is a cutaway top view of the mounting system of FIG. 11.

For vertical use, the double-opening configuration of FIGS. 8 and 9 is preferred. This is shown in two possible configurations in FIGS. 11–14. In the embodiment of FIGS. 11 and 12, a horizontal shelf 54 is attached to a perpendicularly oriented vertical member 56 configured in the manner of the plate or bar 26 of FIGS. 8 and 9. The releasable trap channel 32 is vertically mounted to the wall panel 46 and the vertical member 56 is releasably gripped therein to hold the shelf 54 to the wall.

Figure 13:
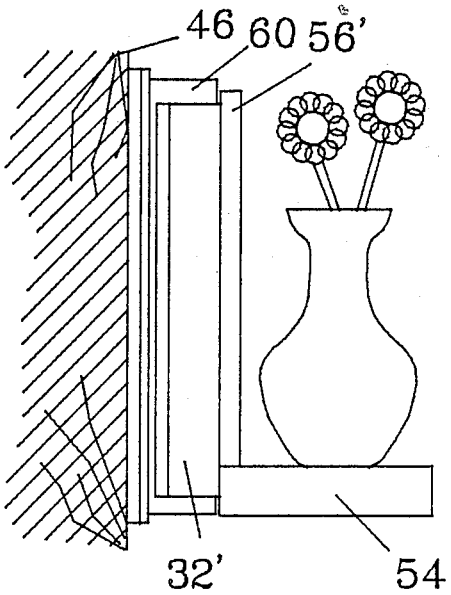
FIG. 13 is a side elevation corresponding to that of FIG. 11 showing an alternate method wherein the shear trap channel is attached to the removable shelf.
Figure 14:
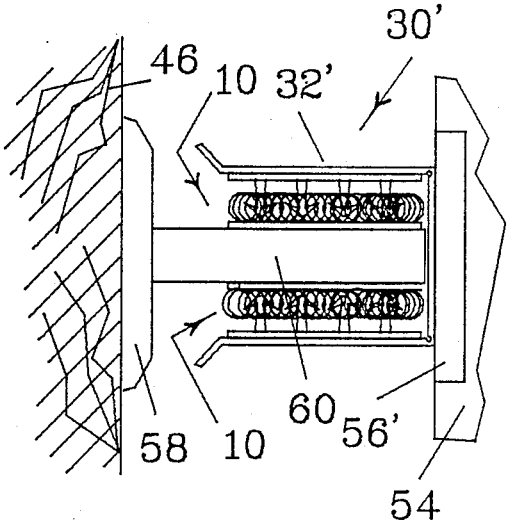
FIG. 14 is a cutaway top view of the apparatus of FIG. 13.

In the embodiment of FIGS. 13 and 14, the vertical member 56' extending from the horizontal shelf 54 is parallel to the wall panel 46 and has the releasable trap channel 32 mounted thereto. A mounting plate 58 is attached to the wall panel 46 and has a vertical bar 60 extending perpendicularly therefrom, which acts in the manner of the bar or plate 26 previously described.

Figure 15:
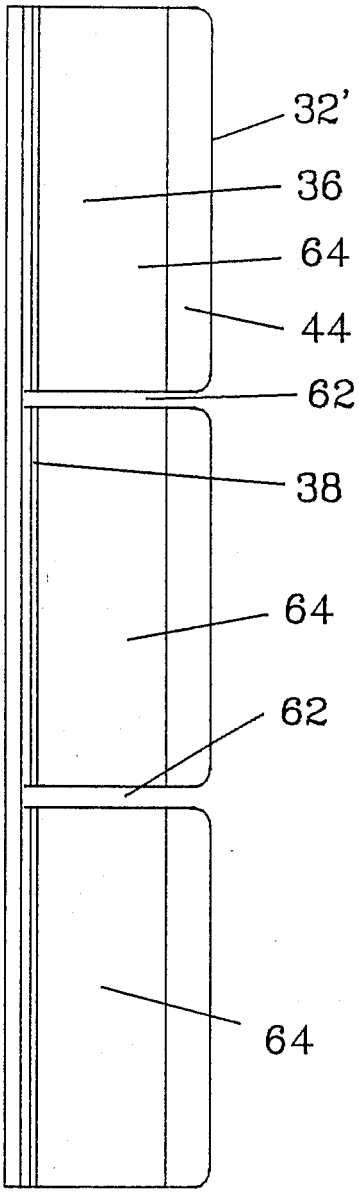
FIG. 15 is a side view of an elongated shear trap channel according to the present invention wherein the side portions have been divided into a plurality of side members which are individually pivotable about the back portion.

Several additional variations and modifications of the present invention will now be described with respect to FIGS. 15–21. Turning first to FIG. 15, where the shear trap channel 32 is of any length, it is preferred that the side portions 36 be subdivided as by slits 62 so as to form a plurality of contiguous side members 64. The providing of individually releasable side members 64 serves two purposes. For one, it makes release of the side portions 36 easier. More importantly, however, if, for example, an elongated trap channel is used for attaching a plurality of shelves, or the like, to a wall vertically one above the other, the separate side members 64 allow individual brackets for shelves to be added or removed without requiring that all be released.

Figure 16:
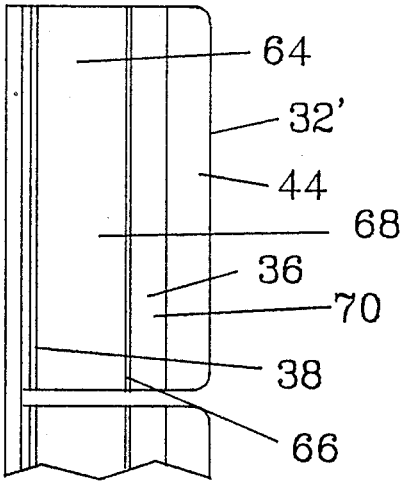
FIG. 16 is a side view of a portion of an elongated shear trap channel wherein a second living hinge is disposed in the side portions to provide a a pivotable gripping portion therein.
Figure 17:
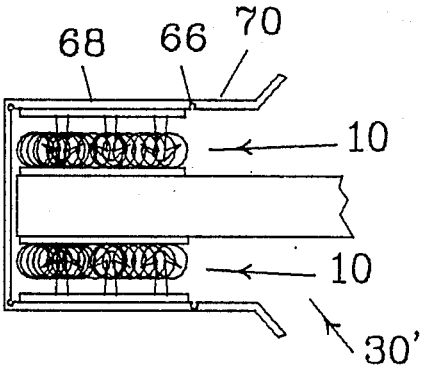
FIG. 17 is a top view of the shear trap channel of FIG. 16.
Figure 18:
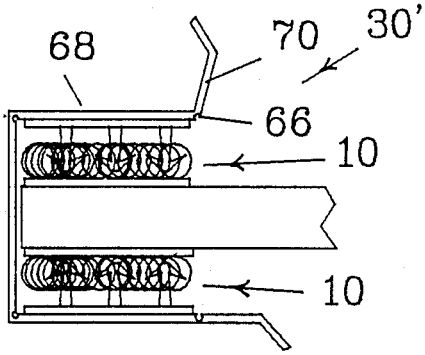
FIG. 18 is a top view of the shear trap channel of FIGS. 16 and 17 with the gripping portion pivoted out to its gripping position.

Another modification to the basic structure is shown in FIGS. 16–18. For larger loading applications, the force required to move the side portions 36 (whether subdivided into side members 64 or not) out of engagement may still be quite large. In order to provide a firmer grip in these instances, it is preferred that the side portions 36 be provided with a second longitudinal living hinge 66 to divide the side portions 36 into a back segment 68 and a front segment 70. The hook and loop material attached to the side portion is only provided in the back portion as best seen in FIG. 17. To remove the side portion 36 from engagement, the front segment 70 is rotated back to the position of FIG. 18 wherein a first grip can be obtained so as to pull the back segment from engagement.

Figure 19:
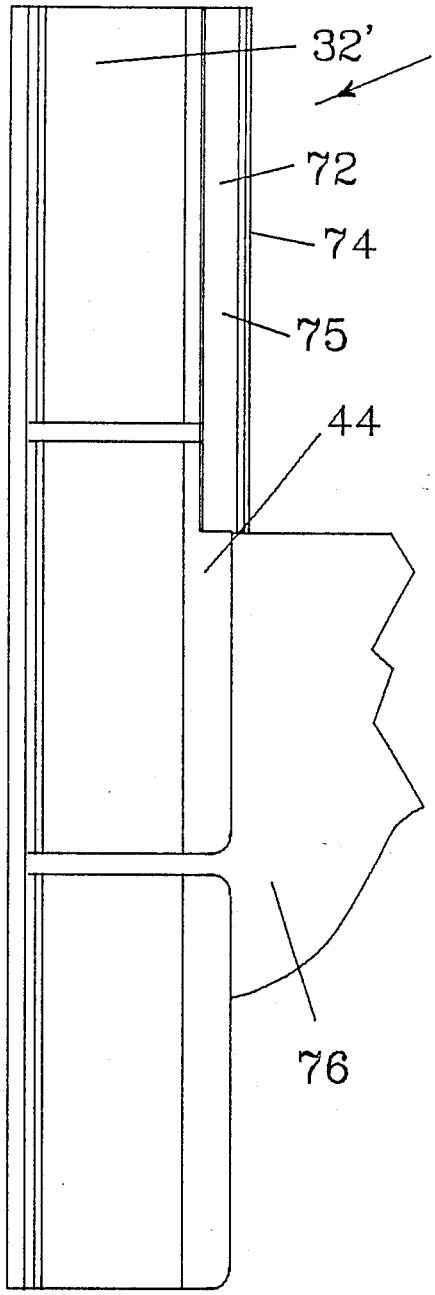
FIGS. 19 and 20 are respectively a side view and a top view of the shear trap channel of FIG. 15 showing the addition of a front locking and decorative strip.
Figure 20:
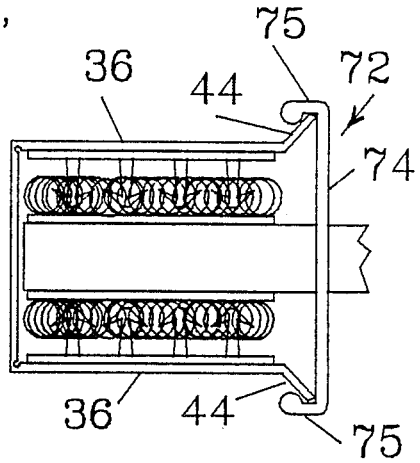

The next modification to be considered is shown in FIGS. 19 and 20 and comprises the locking/decorative strip 72. Strip 72 comprises a decorative front panel 74 having ears 75 extending backwards therefrom which are adapted to snap around the side portions 36 (and in particular the gripping lips 44). The strip 72 prevents the side portions 36 from moving outward and, therefore, locks the trap channel 32 in its engaged position. As best seen in FIG. 19, the strip 72 is adapted to cover the front of the trap channel 32 except in those areas where a component such as the shelf bracket 76 is extending outward from therebetween. In this regard, it is in a decorative manner to cover the edges of th side portions 36 and the hook and loop fastening material within. If desired, a decorative design could be put on the front panel to add to the decorative effect. The locking strip could in an alternative embodiment be formed integrally with one of the channel side portions.

Figure 21:
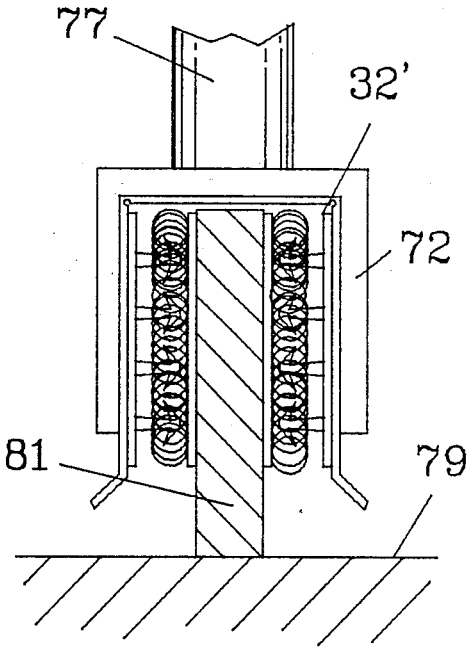
FIG. 21 is an end view of an alternate embodiment of the locking strip as employed in a system for fastening airplane seats, and the like, to a floor ridge.
Figure 22:
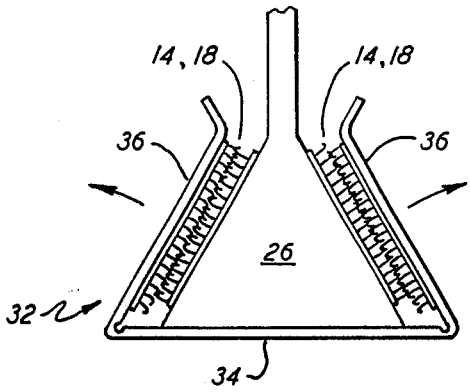
FIG. 22 shows an alternative cross-section for the channel in which the channel side converge toward the open end of the channel to engage a bar or plate member of triangular cross-section with hook and loop material therebetween in shear, the channel sides being hinged to the channel back for movement in the direction of the arrows.
Figure 23:
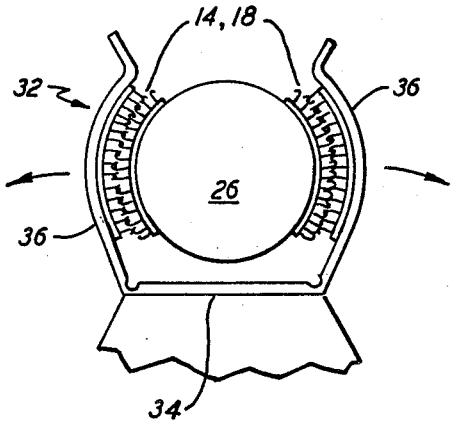
FIG. 23 shows a further alternative channel cross-section in which the sides are curved to engage a circular bar.

An alternate embodiment of the locking strip concept is shown in FIG. 21 wherein it is employed to retain an airplane seat frame 77 (which, although not instantly apparent from the drawing, is attached to the trap channel 32' therein) firmly attached to the floor 79 of the airplane (not shown) until it is time for seat reconfiguration. Mounting ridge 81 extending upward from the floor 79 performs the function of the bar or plate 26 previously referred to. The locking strip 72 in this instance is pressed down over the side portions 36 to lock them firmly in place.

It will be appreciated by those skilled in the art that this invention has wide application and is susceptible to many variations without departing from the basic hinged hook and loop separable fastener shear trap support system concept of the invention. An example of the variations referred to is the freedom with which the hinged channel member carrying hook or loop material on its interior parallel surfaces may be adapted to be part of the support structure or to be part of the supported structure with the cooperating member carrying an opposed exterior surface, the other of the hook or loop material being the other of the supported structure or the support structure.

It will also be appreciated that interior faces of the hinged channel may be widely spaced apart and that the cooperating member might be, for example, a wall or floor panel dimensioned from hook or loop material attached to opposed edges thereof to engage the other of the hook or loop material on said interior faces. Indeed, for example, without departing from the inventive concept, the hinged shear channel arrangement might comprise two such hinged channels disposed at right angles to bound within their interior walls a rectangle to engage the four sides of a similarly sized rectangular element.

Further the channel members may be co-extrusions comprising materials of different properties (e.g. durometer) one of which forms the hinge(s) and the other(s) the remainder of the channel members.

A touch fastener, as used in this application, comprises a first planar backing material having a surface carrying hooks, mushrooms, balls on stems, pigtails, or the like, capable of engaging loops, hooks, mushrooms, balls on stems, pigtails, or the like, carried by a second planar backing material to releasably fasten components together. Terms herein referring to hook and loop fastening systems and parts thereof shall be construed to include other types of touch fasteners in which the fastening strength in shear (i.e. against forces applied in the plane of the fastener) substantially exceeds the fastening strength resisting peeling separation of the fastener by the application of force normal to the plane thereof.

Wherefore, having thus described my invention, I claim:

1. An improved fastening system wherein surfaces of two substantially rigid members are releasably secured to one another by means of a touch fastening system having two mating portions carrying engaging elements, such that engagement of said engaging elements of the mating portions of the touch fastening system position said surfaces of said members in substantially rigid parallel relation and confine said surfaces in a substantially fixed spaced relationship, which space is sufficiently less than the combined height of the engaging elements upstanding from both surfaces, wherein one of said members is configured to substantially surround at least a portion of the second member thereby creating the confinement of relative movement of said members and the progressive resistance of said engaging elements when said members are moved relative to each other, wherein the improvement comprises:

(a) two mating touch fastener portions, one of said touch fastener portions carrying a plurality of projecting engaging elements capable of releasably engaging cooperating projecting elements carried by the other of said touch fastener portions;

(b) a first member comprised of a hinged shear trap channel, said hinged shear trap channel having a rigid back portion interconnecting a pair of rigid opposed side portions, defining inwardly facing surfaces, with one of said touch fastener portions on each inwardly facing surface, said hinged shear trap channel having at least one of its side portions connected to said back portion by a hinge means, said shear trap channel being elongated in its longitudinal dimension; and (c) a second member comprised of a substantially planar, self-supportingly rigid unitary fin member, said substantially planar rigid unitary fin member defining opposed outwardly facing surfaces and having the other of said touch fastener portions on its opposed outwardly facing surfaces, said fin member being of a shape such that said shear trap channel is capable of surrounding the portion of said fin member carrying said touch fastener portions in a closely-fitting manner;

whereby said hinged shear trap channel is capable of receiving said rigid unitary fin member between its inwardly facing surfaces with the two touch fastener portions engaged to act in shear to connect said fin member and said shear trap channel together, said rigid back portion being of a width such that the inwardly and outwardly facing surfaces are all substantially parallel to one another during said engagement, said width being sufficiently less than the combined height of said fin member and said touch fastener portions including their engaging elements, and said at least one hinged side portion being pivotable by means of said hinge means away from said fin member to provide progressive disengagement of the two touch fastener portions when desired, thereby providing an improved fastening system utilizing the substantial holding power of said system in the shear direction, while allowing disengagement of the members in the direction perpendicular to the surfaces of said members by operation of the hinged side portion of said hinged shear trap channel.

2. The improvement of claim 1 wherein:

said hinged shear trap channel has both side portions hingedly attached by hinge means to said back portion.

3. The improvement of claim 1 wherein:

said at least one side portion is subdivided into a plurality of said members which are each individually pivotable about said hinge means.

4. The improvement of claim 1 wherein:

said hinged shear trap channel is formed of plastic and said hinge means comprises a living hinge.

5. The improvement of claim 4 wherein:

said at least one side portion attached to said back portion by said hinge means includes a gripping portion adjacent the front of the hinged shear trap channel whereby said at least one side portion can be gripped to pull the touch fastener portions out of engagement.

6. The improvement of claim 5 and additionally comprising:

a second living hinge disposed longitudinally in said at least one side portion to divide it into a back segment and a front segment which includes said gripping portion and is pivotable to a position wherein it can be more firmly gripped.

7. The improvement of claim 1 and additionally comprising:

a releasable locking means adapted to captively engage both said side portions directly to prevent said side portions from separating and allowing the touch fastener portions to become disengaged.

8. The improvement of claim 7 wherein:

said locking means is adapted to cover the front of all of said hinged shear trap channel not having said fin member disposed therebetween.

9. The improvement of claim 1 wherein:

said hinged shear trap channel is formed integrally with a first member.

10. The improvement of claim 1 wherein;

said rigid unitary fin member is formed integrally with a second member.

11. An improved fastening system wherein surfaces of two substantially rigid members are releasably secured to one another by means of a touch fastening system having two mating portions carrying engaging elements, such that engagement of said engaging elements of the mating portions of the touch fastening system position said surfaces of said members in substantially rigid parallel relation and confine said surfaces in a substantially fixed spaced relationship, which space is sufficiently less than the combined height of the engaging elements upstanding from both surfaces, wherein one of said members is configured to substantially surround at least a portion of the second member thereby creating the confinement of relative movement of said members and the progressive resistance of said engaging elements when said members are moved relative to each other, wherein the improvement comprises:

(a) two touch fastener portions, one of said touch fastener portions carrying a plurality of projecting engaging elements capable of releasably engaging cooperating projecting elements carried by the other of said touch fastener portions;

(b) a first member comprised of a hinged shear trap channel member, said hinged shear trap channel member having a rigid back portion interconnecting a pair of rigid opposed side portions, defining inwardly facing surfaces, with one of said touch fastener portions on each inwardly facing surface, said hinged shear trap channel member having at least one of its side portions connected to said back portion by a hinged attachment, said shear trap channel being elongated in its longitudinal dimension; and (c) a second member comprised of a substantially planar, self-supportingly rigid unitary fin member, said substantially planar rigid unitary fin member defining opposed outwardly facing surfaces and having the other of said touch fastener portions on its opposed outwardly facing surfaces, said fin member being of a shape such that said shear trap channel is capable of surrounding the portion of said fin member carrying said touch fastener portions in a closely-fitting manner:

whereby said hinged shear trap channel member is capable of receiving said rigid unitary fin member between its inwardly facing surfaces with the two touch fastener portions engaged to act in shear to connect said fin member and said shear trap channel member together, said rigid back portion being of a width such that the inwardly and outwardly facing surfaces are all substantially parallel to one another during said engagement, said width being sufficiently less than the combined height of said fin member and said touch fastener portions including their engaging elements, and said at least one hinged side portion being pivotable by means of said hinged attachment away from said fin member to provide progressive disengagement of the two touch fastener portions when desired, thereby providing an improved fastening system utilizing the substantial holding power of said system in the shear direction, while allowing disengagement of the members in the direction perpendicular to the surfaces of said members by operation of the hinged side portion of said hinged shear trap channel.

12. The improvement of claim 11 wherein:

said hinged shear trap channel member has both side portions hingedly attached to said back portion.

13. The improvement of claim 11 wherein:

said at least one side portion is subdivided into a plurality of side members which are each individually pivotable about said hinged attachment to said back portion.

14. The improvement of claim 11 wherein:

said hinged shear trap channel member is formed of plastic and said hinged attachment comprises a living hinge.

15. The improvement of claim 14 wherein:

said at least one side portion attached to said back portion by said living hinge includes a gripping portion whereby said at least one side portion can be gripped to pull the touch fastener portions out of engagement.

16. The improvement of claim 15 and additionally comprising:

a second living hinge disposed longitudinally in said at least side portion to divide it into a back segment and a front segment which includes said gripping portion and is pivotable to a position wherein it can be more firmly gripped.

17. The improvement of claim 11 and additionally comprising:

a releasable locking means adapted to captively engage both said side portions to prevent said side portions from separating and allowing the touch fastener portions to become disengaged.

18. The improvement of claim 17 wherein:

said locking means is adapted to cover all of said hinged shear trap channel member not having said fin member disposed therebetween.

19. The improvement of claim 11 wherein;

said hinged shear trap channel member is formed integrally with a first member; and said rigid unitary fin member is formed integrally with a second member.

20. An improved fastening system wherein surfaces of two substantially rigid members are releasably secured to one another by means of a touch fastening system having two mating portions carrying engaging elements, such that engagement of said engaging elements of the mating portions of the touch fastening system position said surfaces of said members in substantially rigid parallel relation and confine said surfaces in a substantially fixed spaced relationship, which space is sufficiently less than the combined height of the engaging elements upstanding from both surfaces, wherein one of said members is configured to substantially surround at least a portion of the second member thereby creating the confinement of relative movement of said members and the progressive resistance of said engaging elements when said members are moved relative to each other, wherein the improvement comprises:

(a) two touch fastener portions, one of said touch fastener portions carrying a plurality of projecting engaging elements capable of releasably engaging cooperating projecting elements carried by the other of said touch fastener portions;

(b) a first member comprised of a hinged shear trap channel member, said hinged shear trap channel member being integrally formed with a first member, said hinged shear trap channel member having a rigid back portion interconnecting a pair of rigid opposed side portions, defining inwardly facing surfaces, with one of said touch fastener portions on each inwardly facing surface, said hinged shear trap channel member having at least one of its side portions connected to said back portion by a hinged attachment, said shear trap channel being elongated in its longitudinal dimension; and (c) a second member comprised of a substantially planar, self-supportingly rigid unitary fin member, said substantially planar rigid unitary fin member being integrally formed with a second member, said rigid unitary fin member defining opposed outwardly facing surfaces and having the other of said touch fastener portions on its opposed outwardly facing surfaces, said fin member being of a shape such that said shear trap channel is capable of surrounding the portion of said fin member carrying said touch fastener portions in a closely-fitting manner;

whereby said hinged shear trap channel member is capable of receiving said rigid unitary fin member between its inwardly facing surfaces with the two touch fastener portions engaged to act in shear to connect said second member and said first member together, said rigid back portion being of a width such that the inwardly and outwardly facing surfaces are all substantially parallel to one another during said engagement, said width being sufficiently less than the combined height of said fin member and said touch fastener portions including their engaging elements, and said at least one hinged said portion being pivotable by means of said hinged attachment away from said fin member to provide progressive disengagement of the two touch fastener portions when desired, thereby providing an improved fastening system utilizing the substantial holding power of said system in the shear direction, while allowing disengagement of the members in the direction perpendicular to the surfaces of said members by operation of the hinged side portion of said hinged shear trap channel.

21. The improvement of claim 20 wherein:

said back portion is adapted for mounting to a surface by mounting means.

22. The improvement of claim 20 wherein:

one of said side portions is adapted for mounting to a surface by mounting means.

23. The improvement of claim 20 wherein:

said hinged shear trap channel member has both side portions hingedly attached to said back portion.

24. The improvement of claim 20 wherein:

said at least one side portion is subdivided into a plurality of side members which are each individually pivotable about said hinged attachment to said back portion.

25. The improvement of claim 20 wherein:

said hinged shear trap channel member is formed of plastic and said hinged attachment comprises a living hinge.

26. The improvement of claim 25 wherein:

said at least one side portion attached to said back portion by said living hinge includes a gripping portion whereby said at least one side portion can be gripped to pull the touch fastener portions out of engagement.

27. The improvement of claim 26 and additionally comprising:

a second living hinge disposed longitudinally in said at least one side portion to divide it into a back segment and a front segment which includes said gripping portion and is pivotable to a position wherein it can be more firmly gripped.

28. The improvement of claim 20 and additionally comprising:

a releasable locking means adapted to captively engage both said side portions to prevent said side portions from separating and allowing the touch fastener portions to become disengaged.

29. The improvement of claim 28 wherein:

said locking means is adapted to cover all of said hinged shear trap channel member not having said fin member disposed therebetween.

* * * * *

UNITED STATES PATENT AND TRADEMARK OFFICE

CERTIFICATE OF CORRECTION

PATENT NO. : 4,887,338

DATED : December 19, 1989

INVENTOR(S) : Michael D. HANDLER

It is certified that error appears in the above-identified patent and that said Letters Patent is hereby corrected as shown below:

Claim 16, Col. 9, line 65, after "least" insert the word "one".

Signed and Sealed this

Twenty-eighth Day of April, 1992

*Attest:*

HARRY F. MANBECK, JR.

*Attesting Officer*

*Commissioner of Patents and Trademarks*